United States Patent [19]

Hara et al.

[11] Patent Number: 4,861,673

[45] Date of Patent: Aug. 29, 1989

[54] COMPOSITE SINTERED MATERIAL HAVING SANDWICH STRUCTURE

[75] Inventors: Akio Hara; Akihiko Yamamura, both of Hyogo, Japan

[73] Assignee: Sumitomo Electric Industries, Ltd., Osaka, Japan

[21] Appl. No.: 127,604

[22] Filed: Nov. 30, 1987

Related U.S. Application Data

[63] Continuation of Ser. No. 793,825, Nov. 1, 1985, abandoned.

[30] Foreign Application Priority Data

Nov. 1, 1984 [JP] Japan ..... 59-228998

[51] Int. Cl.[4] ..... B32B 15/04

[52] U.S. Cl. ..... 428/469; 428/698

[58] Field of Search ..... 428/469, 698, 699, 408

[56] References Cited

U.S. PATENT DOCUMENTS

| | | | |
|---|---|---|---|
| 3,239,321 | 3/1966 | Blainey et al. | 51/307 X |
| 3,744,982 | 7/1973 | Bovenkerk et al. | 51/307 |
| 3,745,623 | 7/1973 | Wentorf, Jr. et al. | 51/307 X |
| 3,816,085 | 6/1974 | Hall | 51/307 |
| 4,129,052 | 12/1978 | Bieberich | 72/467 X |
| 4,144,739 | 3/1979 | Corbin | 72/467 |
| 4,353,963 | 10/1982 | Lee et al. | 428/698 X |
| 4,403,015 | 9/1983 | Nakai et al. | 428/697 X |
| 4,470,895 | 9/1984 | Coad et al. | 428/698 X |
| 4,536,442 | 8/1985 | Borenkerk et al. | 428/323 |
| 4,686,080 | 8/1987 | Hara et al. | 428/699 X |

*Primary Examiner*—Nancy A. B. Swisher

*Attorney, Agent, or Firm*—Jones, Tullar & Cooper

[57] ABSTRACT

A composite sintered material suitably used as a material for a drill has a sandwich structure comprising a hard layer of a sintered diamond compact including an iron group metal sandwiched between a pair of substrates and intermediate layers. The pair of intermediate layers each has a thickness of 10 to 500 microns. The intermediate layers are bonded respectively to one of the opposite surfaces of the hard layer, with each of the intermediate layers comprising a material which has a thermal expansion coefficient of $3.0\times10^{-6}$ to $6.0\times10^{-6}$/°C. and which prevent the transfer of the iron group metal therethrough in the course of sintering of the hard material. The pair of substrates are bonded respectively to one of the surfaces of the intermediate layers to form a sandwich construction with the hard layer. The substrates comprise a metal or alloy having a thermal expansion coefficient lower than $6.0\times10^{-6}$/°C. In using the composite sintered material as a blade tip for a cutting tool, the sintered diamond compact contains preferably 5 to 15 vol. % of an iron group metal, the balance being of diamond particles, and each of the substrates is composed of a sintered alloy mainly composed of WC and/or MOC having a thermal expansion coefficient lower than $4.6\times10^{-6}$/°C.

3 Claims, 3 Drawing Sheets

COMPOSITE SINTERED MATERIAL HAVING SANDWICH STRUCTURE

This is a continuation of co-pending application Serial No. 793,825 filed on Nov. 1, 1985 now abandoned.

FIELD OF THE INVENTION

The present invention relates to a composite sintered material having a sandwich structure.

More particularly, the present invention relates to a composite sintered material composed of a hard layer of a sintered diamond compact sandwiched between a pair of substrates, which is suitably used as a material for a drill.

BACKGROUND OF THE INVENTION

The sintered diamond compact (which will be hereinafter referred to as "PCD") has been developed as a material for cutting tools of a long life time and has been in recent years widely used as an indispensable material for tools for machining the materials which are hard to work. The usage of PCD, however, is restricted to certain articles, because the production process thereof is too severe to produce a piece of PCD of a complicated configuration.

Particularly in the case of a drilling tool which is fabricated by fitting a blade tip of PCD in the groove of the top end of a shank and blazing the same thereto, PCD is hard to blaze on the shank, which is generally made of steel, together a substrate of a sintered alloy, etc. is bonded to a layer of PCD so that the blade tip is fixed to the shank by blazing the substrate to the shank.

With a blade tip of this type, however, the blazed surface is not very large so that it is not rigidly fixed to the shank. Accordingly, it has been earnestly required to provide a PCD sandwiched with a pair of substrates of sintered alloy, etc.

Further in preparing a tipped drill from a PCD blade tip having a substrate on only one surface thereof, it is necessary to fix a pair of blade tips precisely symmetrically to each other about the rotating center of the drill. But, with a PCD blade tip in which the PCD layer is sandwiched between a pair of substrates, such a complicated positioning of the blade tips is no longer necessary.

Although it has been earnesly required, it has been practically impossible to produce PCD blade tips of sandwich structure and thus such blade tips have not been seen in the market.

SUMMARY OF THE INVENTION

Accordingly, it is an object of the present invention to provide a composite sintered material containing a PCD layer sandwiched between a pair of substrates which can be easily blazed to a shank.

It is another object of the present invention to provide a composite sintered material having a sandwiched structure which can be produced at a high production yield.

it is still a further object of the present invention to provide a composite sintered material suitably used as a blade tip for a drill of a long life time.

According to the present invention, there is provided a composite sintered material having a sandwich structure consisting essentially of:

a hard layer composed of sintered diamond compact;

a pair of intermediate layers each havig a thickness of 10 to 500 microns and bonded respectively to one of the opposite surfaces of the hard layer, each of the intermediate layers consisting of a material which has a thermal expansion coefficient of $3.0 \times 10^{-6}$ to $6.0 \times 10^{-6}/°$ C. and prevents the soaking of the iron group metal therethrough in the course of the sintering of the hard layer; and a pair of substrates bonded respectively to one of the surfaces of the intermediate layers to form a sandwich construction with the hard layer and composed of a metal or alloy having a thermal expansion coefficient lower than $6.0 \times 10^{-6}/°$ C.

In case the composite sintered material is intended for use as a blade tip for a drill, it is preferably that the sintered diamond compact contains 5 to 15 vol% of an iron group metal and the balance being of diamond particles, and that each of the substrates is composed of a sintered alloy mainly composed of WC and/or MoC having a thermal expansion coefficient lower than 4.6 $\times 10^{-6}/°$ C. The substrate is preferably composed of a sintered alloy containing 5 to 2 wt% of Co and /or Ni and the balance being WC and/or MoC According to an embodiment of the present invention, each of the intermediate layers consists essentially of at least one member selected from the group consisting of nitride, carbide, carbonitride, boride, oxide and mutual solid solution thereof of the elements of the IIIb, IVa, IVb, Va, VIa groups of the Periodic Table.

According to a preferred embodiment of the present invention, each of the intermediate layers consists essentially of 80 to 20 wt%, more preferably 80 to 50 wt% of high pressure boron nitride and the balance being at least one member selected from the group consisting of nitride, carbide, carbonitride, boride and mutual solid solution thereof of the elements of the IVa, Va, VIa groups of the Periodic Table.

According to a further preferred embodiment of the present invention, each of the intermediate layers consists of a material obtained by sintering a mixture containing 80 to 50 wt% of high pressure boron nitride and the balance being at least one member selected from the group consisting of TiN, TiC, the mutual solid soltuion thereof, Al and Si.

High pressure boron nitride includes cubic boron nitride and wultzite boron nitride.

According to another embodiment of the present invention, each of the substrates is composed of W or Mo metal and/or the alloy thereof.

DETAILED DESCRIPTION OF THE INVENTION

Figure 1:
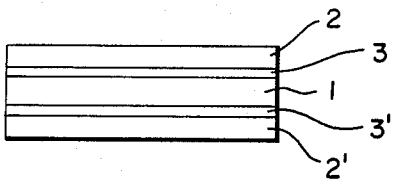
FIG. 1 is a sectional view of a composite sintered material according to the present invention.

As explained in the above, it is preferred to use a PCD blade tip sandwiched by a pair of substrates for rigidly fixing the same to the shank. In Japanese Patent laid-open NO. 57-66805, there is disclosed a composite sintered material in which a layer of PCD or sintered boron nitride is bonded between a pair of plates of cermet. Thus, we prepared such a composite sintered material with PCD.

The experiments revealed that may cracks are developed in the PCD layer and thus it is practically inpossible to produce such a composite sintered material without cracks.

The reason why the cracks occur in the PCD layer is considered as follows:

For producing a composite sintered material composed of a PCD layer sandwiched between a pair of substrates, a layer of a diamond powder containing a bonding agent in the form of a piece or powder is set between a pair of substrates made of a sintered alloy or metal and then sintered at high temperatures and under ultra high pressure to sinter the diamond layer and at the same time bond the thus obtained PCD layer to the substrates. After the sintering is completed, however, the ultra high pressure is released and the sintered material is then cooled down. At this time, there arises a thermal stress due to the difference in the thermal expansion coefficient between the PCD layer and the substrates. If there is a large difference in the thermal expansion coefficient between the PCD layer and the substrates, the residual stress is proportionally larger so that it causes cracking in the PCD layer.

In case that the PCD layer is bonded at only one surface thereof to a substrate, the thermal stress due to the difference of the thermal expansion coefficient is absorbedby the deformation of the sintered material so that there does not occur serious crackig in the PCD layer.

In the case that the PCD layer is sandwiched between a pair of substrates, however, a thermal stress is generated in the tensile direction in both of the opposite surfaces of the PCD layer to cause cracking in the PCD layer itself.

In order to prevent the cracking, we have tried to produce a composite sintered material of which the layers have an adjusted thermal expansion coefficient.

First we noted that the thermal expansion coefficient of the sintered alloy is determined mainly by the ratio between the amounts of the hard phase of carbide and the bonding phase of the iron group metal, and that the lesser the amount of the bonding phase, the lower becomes the thermal expansion coefficient of the sintered alloy.

Table 1 shows the relationship between the Co content and the thermal expansion coefficient of WC-Co sintered alloy.

TABLE 1

| Co (wt %) | thermal expansion coefficient (°C.$^{-1}$) |
|---|---|
| 20 | $6.7 \times 10^{-6}$ |
| 10 | $5.1 \times 10^{-6}$ |
| 6 | $4.7 \times 10^{-6}$ |
| 5 | $4.6 \times 10^{-6}$ |
| 4 | $4.5 \times 10^{-6}$ |
| 3 | $4.4 \times 10^{-6}$ |
| 2 | $4.3 \times 10^{-6}$ |

On the other hand, the thermal expansion coefficient of the PCD layer is dependent also upon the amount of the bonding material as shown in Table 2.

TABLE 2

| Co (vol %) | thermal expansion coefficient (°C.$^{-1}$) |
|---|---|
| 40 | $4.7 \times 10^{-6}$ |
| 30 | $4.2 \times 10^{-6}$ |
| 20 | $4.0 \times 10^{-6}$ |
| 15 | $3.9 \times 10^{-6}$ |
| 10 | $3.8 \times 10^{-6}$ |
| 5 | $3.7 \times 10^{-6}$ |

Further, our experiments and calculations revealed that, if the difference of the thermal expansion coefficient between the PCD layer and the substrate is lower than $0.6 \times 10^{-6}$, there would not be cracking in the PCD layer and thus it would become possible to produce a composite sintered material in PCD having a sandwich structure at a high production yield.

Accordingly, for preventing the occurrence of cracks, the sintered alloy used as a substrate should generally contain lower than 10 wt % of a bonding agent.

In the case of a composite sintered material for use as a blade tip of drills, the PCD layer should contain 15 to 5 vol % of Co for obtaining a sufficiently high cutting performance, while the sintered alloy constituting a substrate therefor should contain 5 to 2 wt % of Co.

Further, in order to lower the thermal expansion coefficient of the PCD layer, it is preferable to incorporate Mo alloy and W alloy such as Mo carbide or W carbide in the PCD layer.

On the other hand, however, it is impossible with sintering technics at their present stage to produce at a high production yield a sintered diamond by sintering only diamond powder without the addition of a bonding agent such as iron group metal.

There has beena second problem to be resolved in order to obtain a composite sintered material. That is, in the ordinary production of PCD, the diamond powder is placed adjacent to a sintered alloy so that the iron group metal contained in the sintered alloy is melted and the diamond powder is impregnated therewith during the sintering at high temperature. Otherwise, a powder of iron group metal is mixed with the diamond powder in advance of the sintering or a thin plate of iron group metal is placed adjacent to the compact of the diamond powder. In this case also, the diamond powder is impregnated with the melted iron group metal during the sintering.

As described in the above, in order to produce a composite sintered material without cracking, it is necessary to lower the content of the iron group metal in the sintered alloy, while the diamond powder should contain a relatively high amount of the bonding metal in order to ensure a good sinter property. But, it is difficult to control the content of the iron group metal of the sintered alloy independently of that in the resulting PCD layer.

That is, when a diamond powder containing a high amount of iron group metal is placed adjacent to a sintered alloy, the iron group metal is melted during the sintering and the sintered alloy is impregnated with the melted iron group metal, so that the content of the iron group metal in the substrates becomes higher with the result that the difference in the thermal expansion coefficient between the resulting PCD and the substrates becomes larger and cracking tends to readily occur in the course of the cooling thereof after the sintering.

On the other hand, if a diamond powder of which the content of iron group metal is also low is placed adjacent to the sintered alloy and then sintered, the sintering can not be conducted with a high production yield.

According to the present invention, these problems have been resolved by employing an intermediate layer to prevent the transfer of the iron group metal from the PCD layer to the substrate, so that a composite sintered material having a sandwich structure can be produced with the layers each having an adjusted thermal expansion coefficient.

As shown in FIG. 1, the composite sintered material according to the present invention consists essentially of a layer of PCD 1, a pair of intermediate layers 3 and 3' and a pair of substrates 2 and 2' which are respectively bonded to one of the opposite surfaces of the PCD layer 1 through the intermediate layer.

That is, the intermediate layers 3 and 3' are employed to prevent the iron group metal contained in the diamond powder from transferring to the substrates 2 and 2'.

The thermal expansion coefficient of the substrates 2 and 2' is preferably as close as possible to that of the PCD layer 1 which is shown in Table 2. Thus, the sintered alloy constituting the substrates 2 and 2' should be lower than $6.0 \times 10^{-6}/°$ C.

As described in the above, the content of the iron group metal in the PCD layer 1 is preferably between 5 and 15 vol %, when the composite sintered material is intended for use as a cutting tool. In this case, the sintered alloy of WC and/or MoC constituting the substrates 2 and 2' should contain iron group metal of 2 to 5 wt %, so that the difference in the thermal expansion coefficient therebetween is less than $0.6 \times 10^{-6}$.

The intermediate layer 3 and 3' should also have a thermal expansion coefficient as close as that of the PCD layer 1 and the substrates 2 and 2'. In this regard, the intermediate layers 3 and 3' should have a thermal expansion coefficient of 3.0 to $6.0 \times 10^{-6}/°$ C. If this condition is not satisfied, the thermal stress due to the difference in the thermal expansion coefficient becomes larger than the bonding strength between the PCD layer 1 or the substrates 2 and 2' and the intermediate layers 3 and 3', so that the sandwich structure of the composite sintered material is broken.

The contact angle of the melted iron group metal or the alloy thereof with the intermediate layer 3 and 3' should be lower than 20° during the sintering of the composite material. When the contact angle is lower than 20°, for example, close to zero degree, the iron group metal contained in the diamond powder 1 readily soaks through the intermediate layer 3 and 3' and transfers into the substrates 2 and 2', so that the content thereof in the substrates 2 and 2' becomes higher to resulting in a large difference in the thermal expansion coefficient between the PCD layer 1 and the substrates 2 and 2'.

The thickness of the intermediate layers 3 and 3' should be between 10 and 500 microns.

With the intermediate layers 3 and 3' of a thickness smaller than 10 microns, the transfer of the iron group metal from the PCD layer 1 to the substrates 2 and 2' can not be prevented effectively. On the other hand, a thickness larger than 500 microns generates a large thermal stress in the interface with the PCD layer 1 or the substrates 2 and 2' and causes the deformation or cracking of the resulting composite sintered material.

Further, with the intermediate layers 3 and 3' of a large thickness, the intermediate layers 3 and 3' should have a thermal expansion coefficient close to that of the PCD layer 1 and the substrate 2 and 2', so that the chemical composition of the employable materials as the intermediate layers 3 and 3' is restricted.

Further, the intermediate layers having a thickness larger than 500 microns would be easily exposed when the composite sintered material is machined in order to fix the same to another part of a working machine by blazing. The intermediate layers 3 and 3' are generally composed of a material which is hard to be blazed, and thus the exposure thereof should not be made.

Although the present invention has been explained mainly with reference to the substrates of sintered alloy, W, Mo, the alloy thereof and the heavy metal which is mainly composed of W can be employed as a material for the substrates 2 and 2', as far as they have a thermal expansion coefficient close to that of the PCD layer 1.

The present invention will be explained in more detail by way of Examples which illustrate the present invention for representing the effect of the present invention. Thus, the Examples should not be construed to restrict the scope of the invention.

EXAMPLE 1

Figure 2:
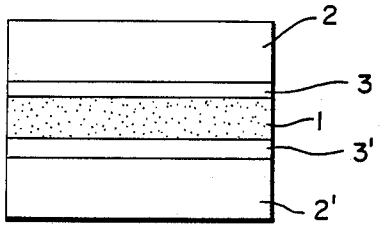
FIG. 2 shows a stack of layers of materials charged in a capsule for preparing a composite sintered material according to an embodiment of the invention.

A diamond powder 1 containing iron group metal, a pair of layers 3 and 3' of materials for the intermediate layers and a pair of layers 2 and 2' of materials for the substrates were stacked in a capsule as shown in FIG. 2. The capsule was charged to a ultra-high pressure and a high temperatures generator and sintered therein under 55,000 atm. at 1400° C.

The occurrence of cracking was observed with the obtained composite sintered material and the results thereof are shown in Table 3 together with their chemical composition.

The Co distribution in the intermediate layers 3 and 3' of the specimens according to the present invention was examined by an x-ray microanalyser (XMA). This examination revealed that the Co content in the intermediate layers 3 and 3' was much lower than that in the PCD layer 1, which means that Co was not soaked through the intermediate layers.

TABLE 3

| | Substrate | intermediate layer | PCD layer | occurrence of cracking |
|---|---|---|---|---|
| *** | 10 wt % Co—WC | none | 5 to 10μ diamond | cracking in center |
| | 4 wt % Co—WC | none | 5 to 10μ diamond | portion of PCD layer |
| *** | 4 wt % Co—WC | TaN | 10 vol % Co-5 to 10μ | without cracking |

TABLE 3-continued

| | Substrate | intermediate layer | PCD layer | occurrence of cracking |
|---|---|---|---|---|
| | | | diamond | |
| | " | ZrN | " | " |
| | " | $Cr_3C$ | " | " |
| | " | HfC | " | " |
| | " | $VB_2$ | " | " |
| | " | $ZrB_2$ | 15 vol % Co-0 to 2μ diamond | " |
| | " | $V_2O_3$ | " | " |
| | " | $Si_3N_4$ | " | " |
| | " | AlN | " | " |
| | " | SiC | " | " |
| | " | $ZrO_2.SiO_2$ | 8 vol % Co-0 to 20μ diamond | " |
| **** | " | 60 vol % CBN(*) —TiN | 10 vol % Co-5 to 10μ diamond | " |
| | " | 60 vol % CBN(*) —$Cr_3C_2$ | " | " |
| | " | 50 vol % CBN(*) —TiCN | " | " |
| | " | 70 vol % CBN(*) —$Al_2O_3$ | " | " |
| | " | 60 vol % CBN —MgO | " | " |
| | W | 60 vol % CBN(*) (TiTa)(CNO) | " | " |
| | Mo | 80 vol % CBN(*) —Ti $B_2$ —TiN | " | " |
| | W-2% Ni 2% Cu | 60 vol % wBN(**) —TiC | " | " |
| *** | 4 wt % Co—WC | W | " | cracking in center portion of PCD layer |
| | " | Ti | " | |

(*)CBN: cubic boron nitride
(**)wBN: wultzite boron nitride
***: control example
****: INVENTION

EXAMPLE 2

Figure 3:
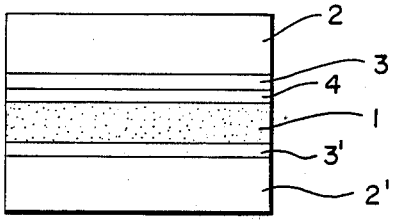
FIG. 3 shows a stack of layers charged in a capsule for preparing a composite sintered material according to another embodiment of the invention.

As shown in FIG. 3, a disc of WC-4%Co sintered alloy having a diameter of 30mm and a thickness of 3mm was coated with a powder mixture of TiN containing 60% of CBN and then put in a capsule to constitute a substrate 2' and an intermediate layer 3' respectively. 2 grams of a diamond powder having a particle size of 5 to 10 microns and a plate of Co having a diameter of 30mm and a thickness of 200 microns was put on the upper surface of the intermediate layer 3' to constitute the PCD layer 1 and the bonding agent therefor respectively. Further, another disc of WC-4%Co having the same shape as a above disc but coated with the powder mixture of 60% CBN-TiN on the lower surface was put in the capsule on the upper surface of the Co plate 4 to constitute a substrate 2 and an intermediate layer 3.

The capsule was then charged in a hot press machine and sintered under 55,000 atm. at 1400° C. for 15 minutes.

Any of the obtained composite sintered materials did not present any cracking. The specimens were cut transversely. The microscopic observatoin on the transverse section revealed that the Co plate 4 had been melted and filled completely between the diamond particles and that the intermediate layers 3 and 3' were scarcely soaked with Co.

EXAMPLE 3

Layers of materials for the PCD layer 1, the substrates 2 and 2' and the intermediate layers 3 and 3' respectively having a chemical composition as shown in Table 4 were sintered in the same manner as in Example 1. The CBN powder had a particle size of about 4 microns. The observation as to cracking is also shown in Table 4.

Figure 4A:
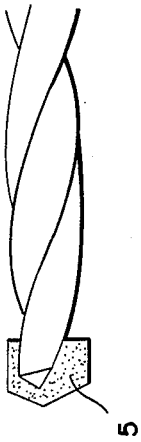
FIG. 4 (*a*) is a side view of a twist drill which comprises a blade tip made from a composite sintered material according to the present invention, and FIG. 4 (*b*) is another side view of the above twist drill.
Figure 4B:
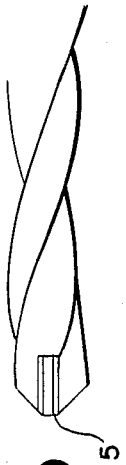

Further, a twist drill of 6mm in diameter as shown in FIG. 4 was prepared from each of the specimens A to F and mounted on a drilling machine for drilling holes in an alloy of 20% Si-Al at 1500 rpm.

The twist drills made from the specimens A, B, D and F operated satisfactorily for 50,000 to 70,000 hits until they had to be exchanged because of wearing, while the drills made from the specimens C and D had to be exchanged because of wearing after 5,000 hits and 20,000 hits, respectively.

TABLE 4

| | substrate | starting material of intermediate layer | PCD layer | number of specimens in which cracking was obserbed for 10 specimens |
|---|---|---|---|---|
| A | 10 wt % Co—WC | 60 vol % CBN -30% TiN-10% Al | 15 vol % Co-5 to 10μ diamond powder | 5 |
| B | 6 wt % Co—WC | " | 15 vol % Co-5 to 10μ diamond powder | 3 |
| C | 10 wt % Co—WC | " | 40 vol % Co-5 to 10μ diamond powder | zero |
| D | 6 wt % Co—WC | " | 20 vol % Co-5 to 10μ diamond powder | 1 |

TABLE 4-continued

| | substrate | starting material of intermediate layer | PCD layer | number of specimens in which cracking was obserbed for 10 specimens |
|---|---|---|---|---|
| E | 5 wt % Co-WC | " | 15 vol % Co-5 to 10μ diamond powder | 1 |
| F | 4 wt % Co—WC | " | 15 vol % Co-5 to 10μ diamond powder | zero |

EXAMPLE 4

A diamond powder having a particle size of 1 to 20 microns and containing 10wt% of 5%Fe-45%Ni-50%Co, and WC-5%Co sintered alloy respectively was used as a material for the PCD layer 1 and for the substrates 2 and 2' together with mixtures of powder for the intermediate layers 3 and 3' of which the chemical compositions are shown in Table 5.

These materials were charged in a capsule as shown in FIG. 2 and sintered under 55,000 atm. at 1400° C.

Any of the thus sintered composite materials did not present any cracking.

TABLE 5

| CBN (vol %) | Balance |
|---|---|
| 80 | TiTa (CN) |
| 60 | 20% TiC + 20% TiN |
| 50 | 40% TiN + 10% WC |
| 20 | $TiB_2$ + $Ti_2AlN$ + TiN |
| 60 | TiCN |

EXAMPLE 5

As shown in FIG. 3, 2.0g of a mixture of a diamond powder of a particle size between 1 and 10 microns and 10wt% of a powder of WC-10%Co of a particle size of 1 to 2 microns was put in a capsule as the PCD layer 1 and a pair of Co plates 4 each having a thickness of 0.2mm were put on the opposite surfaces of the PCD layer 1. Further, on both of the lower and upper sides of the stacked layers 1 and 4, 0.25g of a powder of 60vol%CBN - 40vol%TiN and a disc of WC-4%Co having a diameter of 30mm and a thickness of 3mm were placed as the intermediate layers 3, 3' and the substrates 2 and 2'. The thus obtained stacked layers in the capsule were charged in a ultra-high pressure and high temperature generator of Gardle type and maintained under 55 kb at 1500° C. for 15 minutes to thereby obtain a composite sintered material having a diameter of 30mm and a height of 6.5mm.

All of the resulting composite sintered materials were free of cracking.

EXAMPLE 6

A pair of discs each having a diameter of 30mm and a thickness of 3mm and containing 3wt% of Co, 2wt% of Ni and the balance being of (Mo, W)C were coated on one surface with about 0.2g of a mixture of 60% of CBN and the balance of TiN which had been prepared by using a solvent of methyl alcohol. As the PCD layer 1, 3g of a diamond powder having a particle size of 1 to 20 microns was used.

The capsule in which the above layers were stacked as shown in FIG. 2 was charged in a ultra-high pressure and high temperature generator and then sintered under about 55 kb at 1400°C. The resulting composite sintered materials were free of cracking.

As described in the above, the present invention successfully provides a composite sintered material having a large surface to be blazed with a tool holder having excellent mechanical properties and free from cracking, which is suitable particularly as a blade tip for drills.

As shown in FIGS. 4 (*a*) and (*b*), the composite sintered material according to the present invention may be machined into a pentagonal form 5 such as a Japanese chess piece and fixed to the top end of a shank to obtain a twist drill.

Figure 5A:
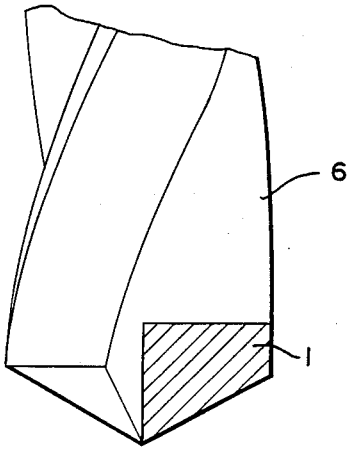
FIG. 5 (*a*) is an enlarged side view of the top portion of the twist drill shown in FIGS. 4 (*a*) and (*b*), and FIG. 5 (*b*) is a top view of the above twist drill.
Figure 5B:
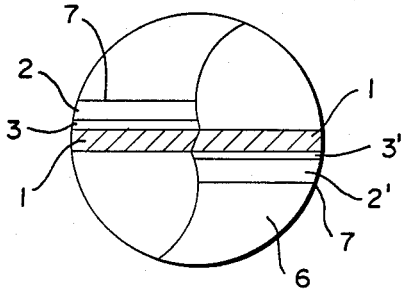

Referring to FIGS. 5 (*a*) and (*b*), a twist drill containing a blade tip made from the composite sintered material of the present invention will be explained in more detail.

The composite sintered material of the present invention is first cut to a pentagonal shape to form a blade tip and applied with a blazing material 4 on the surfaces of the substrates. The blade tip 5 is then inserted by pressing it into a groove which has been made on the top end of the shank 6. Then, the surface of the blade tip is ground to remove a portion of the substrate and the intermediate layer to expose the PCD layer 1 to thereby form a pair of cutting faces in a symmetrical disposition to each other about the rotating center of the drill.

By employing the composite sintered material according to the present invention, it is easy to position the cutting faces symmetrically to each other about the rotating center of the drill.

Further as shown in FIG. 5 (*b*), the forces due to the cutting operation are applied through the substrates 2, 2' and the intermediate layers 3, 3' to the drill in a symmetrical direction to each other about the rotating center of the drill so that the stresses exerted in the drill are well balanced even in the cutting operation at high speed. Moreover, because the cutting faces are constructed by the PCD layer 1 which is integral with the composite sintered material, the influence of the cutting load is further released.

The composite sintered material of the present invention may be of course used as a blade tip not only for a twist drill but also for a straight fluted drill.

Further, the composite sintered material may be used as a material for articles such as a glass cutting tool and a drawing roll which must be fixed to the holder with high strength.

Figure 6B:
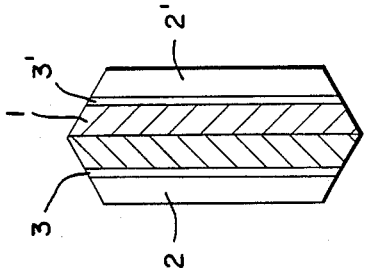
FIG. 6 (*a*) is a side view of a glass cutting tool prepared from a composite sintered material of the present invention, and FIG. 6 (*b*) is a front view thereof.
Figure 6A:
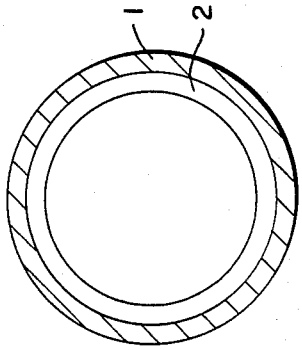

FIGS. 6 (*a*) and (*b*) show a glass cutting tool made from a composite sintered material of the present invention. FIG. 6 (*a*) is a side view of the glass cutting tool and FIG. 6 (*b*) is a front view thereof.

Figure 7B:
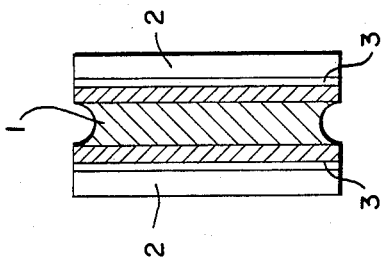
FIG. 7 (*a*) is a side view of a drawing roll prepared from a composite sintered material of the present invention, and FIG. 7 (*b*) is a front view thereof.
Figure 7A:
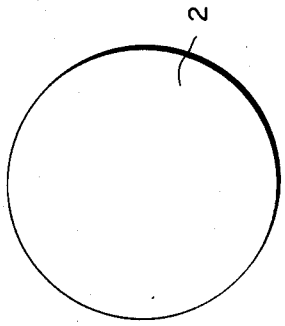

Further the composite sintered material of the present invention may be used as a drawing roll as shown in FIGS. 7 (*a*) and (*b*). FIG. 7 (*a*) is a side view of the drawing roll and FIG. 7 (*b*) is a front view thereof.

Because the glass cutting tool and the drawing roll are made of a composite sintered material comprising a pair of substrates which are readily fixed to a holder, they are very convenient for practical use.

We claim:

1. A composite sintered material having a sandwich structure comprising:

a hard layer of sintered diamond compact comprising 5 to 15 vol % of an iron group metal and the balance of diamond particle;

a pair of intermediate layers each having a thickness of 10 to 500 microns and being bonded respectively to one of the opposite surfaces of said hard layer, each of said intermediate layers consisting essentially of 80 to 20 wt % of high-pressure boron nitride and the balance which is at least one member selected from the group consisting of nitride, carbide, carbonitride, boride, oxide and mutual solid solution thereof of the elements which belong to the IIIb, IVa, IVb, Va or VIa groups of the Periodic Table; and a pair of substrates bonded respectively to one of the surfaces of said intermediate layers to form a sandwich construction with said hard layer, each of said substrates comprising a sintered alloy composed of 5 to 2 wt % of Co and/or Ni and the balance of Wc and/or MoC.

2. The composite sintered material having a sandwich structure as claimed in claim 1, wherein said intermediate layers have a thermal expansion coefficient of 3.0 $\times 10^{-6}$ to 6.0 $\times 10^{-6}$/° C., and wherein said substrates have a thermal expansion coefficient which is lower that 6.0 $\times 10^{-6}$/° C.

3. The composite sintered material having a sandwich structure as claimed in claim 1, wherein each of said intermediate layers contains 80 to 50 wt % of high pressure boron nitride.

* * * * *